US006361918B1

(12) United States Patent
Dickerson et al.

(10) Patent No.: US 6,361,918 B1
(45) Date of Patent: Mar. 26, 2002

(54) HIGH SPEED RADIOGRAPHIC FILM AND IMAGING ASSEMBLY

(75) Inventors: Robert E. Dickerson, Hamlin; Carl R. Preddy, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/706,977

(22) Filed: Nov. 6, 2000

(51) Int. Cl.[7] ..... G03C 5/16

(52) U.S. Cl. ..... 430/139; 430/496; 430/508; 430/966; 430/567; 430/963; 430/502

(58) Field of Search ..... 430/139, 496, 430/502, 508, 966, 567, 963

(56) References Cited

U.S. PATENT DOCUMENTS

| | | | | |
|---|---|---|---|---|
| 4,803,150 A | | 2/1989 | Dickerson et al. | |
| 4,900,652 A | | 2/1990 | Dickerson et al. | |
| 4,994,355 A | | 2/1991 | Dickerson et al. | |
| 4,997,750 A | | 3/1991 | Dickerson et al. | |
| 5,021,327 A | | 6/1991 | Bunch et al. | |
| 5,108,881 A | | 4/1992 | Dickerson et al. | |
| 5,344,749 A | | 9/1994 | Kiekens et al. | |
| 5,482,813 A | * | 1/1996 | Tadashi | 430/139 |
| 5,541,028 A | | 7/1996 | Lee et al. | |
| 5,576,156 A | | 11/1996 | Dickerson | |
| 5,952,162 A | | 9/1999 | Dickerson et al. | |
| 6,180,844 B1 | * | 2/2001 | Dickerson et al. | 430/359 |
| 6,190,822 B1 | * | 2/2001 | Dickerson et al. | 430/139 |
| 6,200,723 B1 | * | 3/2001 | Dickerson et al. | 430/139 |

OTHER PUBLICATIONS

Visual optimization of radiographic tone scale, H–C Lee et al, SPIE vol. 3036, 1997.

* cited by examiner

*Primary Examiner*—Geraldine Letscher
(74) *Attorney, Agent, or Firm*—J. Lanny Tucker

(57) ABSTRACT

High speed and high contrast radiographic films can be imaged in radiographic imaging assemblies comprising intensifying screens. These films having a tabular silver halide emulsions on each side of a film support. At least one emulsion comprises a rhodium dopant and has higher photographic speeds than the other emulsions despite the fact that the emulsion grains have a small average thickness of from about 0.09 to about 0.11 $\mu$m.

19 Claims, No Drawings

HIGH SPEED RADIOGRAPHIC FILM AND IMAGING ASSEMBLY

FIELD OF THE INVENTION

This invention is directed to a high speed and high contrast radiographic film that can be rapidly processed and directly viewed. This invention also provides a film/screen imaging assembly for radiographic purposes, and a method of processing the film to obtain a high contrast black-and-white image.

BACKGROUND OF THE INVENTION

Over one hundred years ago, W. C. Roentgen discovered X-radiation by the inadvertent exposure of a silver halide photographic element. In 1913, Eastman Kodak Company introduced its first product specifically intended to be exposed by X-radiation (X-rays). Today, radiographic silver halide films account for the overwhelming majority of medical diagnostic images. Such films provide viewable black-and-white images upon imagewise exposure followed by processing with the suitable wet developing and fixing photochemicals.

In medical radiography an image of a patient's anatomy is produced by exposing the patient to X-rays and recording the pattern of penetrating X-radiation using a radiographic film containing at least one radiation-sensitive silver halide emulsion layer coated on a transparent support. X-radiation can be directly recorded by the emulsion layer where only low levels of exposure are required. Because of the potential harm of exposure to the patient, an efficient approach to reducing patient exposure is to employ one or more phosphor-containing intensifying screens in combination with the radiographic film (usually both in the front and back of the film). An intensifying screen absorbs X-rays and emits longer wavelength electromagnetic radiation that the silver halide emulsions more readily absorb.

Another technique for reducing patient exposure is to coat two silver halide emulsion layers on opposite sides of the film support to form a "dual coated" radiographic film so the film can provide suitable images with less exposure. Of course, a number of commercial products provide assemblies of both dual coated films in combination with two intensifying screens to allow the lowest possible patient exposure to X-rays. Typical arrangements of film and screens are described in considerable detail for example in U.S. Pat. No. 4,803,150 (Dickerson et al), U.S. Pat. No. 5,021,327 (Bunch et al) and U.S. Pat. No. 5,576,156 (Dickerson).

Radiographic films that can be rapidly wet processed (that is, processed in an automatic processor within 90 seconds and preferably less than 45 seconds) are also described in the noted U.S. Pat. No. 5,576,156. Typical processing cycles include contacting with a black-and-white developing composition, desilvering with a fixing composition, and rinsing and drying. Films processed in this fashion are then ready for image viewing. In recent years, there has been an emphasis in the industry for more rapidly processing such films to increase equipment productivity and to enable medical professionals to make faster and better medical decisions.

As could be expected, image quality and workflow productivity (that is processing time) are of paramount importance in choosing a radiographic imaging system [radiographic film and intensifying screen(s)]. One problem encountered using known systems is that these requirements are not necessarily mutually inclusive. Some film/screen combinations provide excellent image quality but cannot be rapidly processed. Other combinations can be rapidly processed but image quality may be diminished. Both features are not readily provided at the same time. Still again, some films have high contrast but lack sufficient photographic speed.

Rhodium-doped emulsions have been used in the graphic arts industry as well as radiography in recent years to provide films for radiation therapy imaging. Such emulsions are generally useful for obtaining high contrast images. Generally, higher contrast is achieved as a result of a significant loss in photographic speed as the rhodium dopant preferentially slows down the largest and fastest silver halide grains in the emulsion. As a result of the loss in speed, rhodium dopants are used generally only in the slower speed films.

In radiology, X-radiation exposure is very important as excessive X-radiation is potentially harmful and a design of a very slow speed film would be impractical. With these constraints in mind, the industry has been looking for a radiation therapy film and film/screen combination that has the desired image quality, rapid processability, high contrast and high speed.

SUMMARY OF THE INVENTION

The present invention provides a solution to the noted problems with a high speed radiographic silver halide film comprising a support having first and second major surfaces and that is capable of transmitting X-radiation,

- the film having disposed on the first major support surface, one or more hydrophilic colloid layers including a silver halide emulsion layer, and on the second major support surface, one or more hydrophilic colloid layers including a silver halide emulsion layer,
- each of the silver halide emulsion layers comprising silver halide tabular grains that (a) have the same or different composition in each silver halide emulsion layer, (b) account for at least 50% of the total grain projected area within each silver halide emulsion layer, (c) have an average thickness of from about 0.09 to about 0.11 $\mu$m, and (d) have an average aspect ratio of greater than 5,
- all hydrophilic layers of the film being fully forehardened and wet processing solution permeable for image formation within 45 seconds, and
- one or more of the silver halide emulsion layers also comprising a rhodium dopant for the tabular silver halide grains, the rhodium dopant being present independently, in an amount of from about $1\times10^{-5}$ to about $5\times10^{-5}$ mole per mole of silver.

This invention also provides a radiographic imaging assembly comprising the radiographic film described above provided in combination with an intensifying screen on either side of the film.

Further, this invention provides a method comprising contacting the radiographic film described above, sequentially, with a black-and-white developing composition and a fixing composition, the method being carried out within 90 seconds to provide a black-and-white image.

The films of this invention have high speed and can provide high contrast black-and-white image using specific amounts of rhodium dopants and silver halide grains having a specific average thickness. Particulate microcrystalline dyes that are often used to provide crossover control are not present in the films of this invention.

In addition, all other desirable sensitometric properties are maintained, crossover is desirably low, and the films can be rapidly processed in conventional processing equipment and compositions.

DETAILED DESCRIPTION OF THE INVENTION

The term "contrast" as herein employed indicates the average contrast (also referred to as γ) derived from a characteristic curve of a radiographic element using as a first reference point (1) a density ($D_1$) of 0.25 above minimum density and as a second reference point (2) a density ($D_2$) of 2.0 above minimum density, where contrast is ΔD (i.e. 1.75)÷$\Delta\log_{10}E$ ($\log_{10}E_2-\log_{10}E_1$), $E_1$ and $E_2$ being the exposure levels at the reference points (1) and (2).

"Lower scale contrast" is the slope of the characteristic curve measured between of a density of 0.85 to the density achieved by shifting −0.3 log E units.

"Upper scale contrast" is the slope of the characteristic curve measured between a density of 1.5 above $D_{min}$ to 2.5 above $D_{min}$.

"Mid-scale contrast" is the slope of the characteristic curve measured between a density of 0.25 above $D_{min}$ to 2.0 above $D_{min}$ Photographic "speed" refers to the exposure necessary to obtain a density of at least 1.0 plus $D_{min}$.

"Dynamic range" refers to the range of exposures over which useful images can be obtained.

The term "fully forehardened" is employed to indicate the forehardening of hydrophilic colloid layers to a level that limits the weight gain of a radiographic film to less than 120% of its original (dry) weight in the course of wet processing. The weight gain is almost entirely attributable to the ingestion of water during such processing.

The term "rapid access processing" is employed to indicate dry-to-dry processing of a radiographic film in 45 seconds or less. That is, 45 seconds or less elapse from the time a dry imagewise exposed radiographic film enters a wet processor until it emerges as a dry fully processed film.

In referring to grains and silver halide emulsions containing two or more halides, the halides are named in order of ascending concentrations.

The term "equivalent circular diameter" (ECD) is used to define the diameter of a circle having the same projected area as a silver halide grain.

The term "aspect ratio" is used to define the ratio of grain ECD to grain thickness.

The term "coefficient of variation" (COV) is defined as 100 times the standard deviation (a) of grain ECD divided by the mean grain ECD.

The term "tabular grain" is used to define a silver halide grain having two parallel crystal faces that are clearly larger than any remaining crystal faces and having an aspect ratio of at least 2. The term "tabular grain emulsion" refers to a silver halide emulsion in which the tabular grains account for more than 50% of the total grain projected area.

The term "covering power" is used to indicate 100 times the ratio of maximum density to developed silver measured in $mg/dm^2$.

The term "rare earth" is used to refer to elements having an atomic number of 39 or 57 to 71.

The term "front" and "back" refer to locations nearer to and further from, respectively, the source of X-radiation than the support of the film.

The term "dual-coated" is used to define a radiographic film having silver halide emulsion layers disposed on both the front- and backsides of the support.

The radiographic films of this invention include a flexible support having disposed on both sides thereof: one or more silver halide emulsion layers and optionally one or more non-radiation sensitive hydrophilic layer(s). The silver halide emulsions in the various layers can be the same or different, and can comprise mixtures of various silver halide emulsions in or more of the layers.

In preferred embodiments, the film has the same silver halide emulsions on both sides of the support. It is also preferred that the films have a protective overcoat (described below) over the silver halide emulsions on each side of the support.

The support can take the form of any conventional radiographic element support that is X-radiation and light transmissive. Useful supports for the films of this invention can be chosen from among those described in *Research Disclosure*, September 1996, Item 38957 XV. Supports and *Research Disclosure*, Vol. 184, August 1979, Item 18431, XII. Film Supports. *Research Disclosure* is published by Kenneth Mason Publications, Ltd., Dudley House, 12 North Street, Emsworth, Hampshire P010 7DQ England.

The support is a transparent film support. In its simplest possible form the transparent film support consists of a transparent film chosen to allow direct adhesion of the hydrophilic silver halide emulsion layers or other hydrophilic layers. More commonly, the transparent film is itself hydrophobic and subbing layers are coated on the film to facilitate adhesion of the hydrophilic silver halide emulsion layers. Typically the film support is either colorless or blue tinted (tinting dye being present in one or both of the support film and the subbing layers). Referring to *Research Disclosure*, Item 38957, Section XV Supports, cited above, attention is directed particularly to paragraph (2) that describes subbing layers, and paragraph (7) that describes preferred polyester film supports.

In the more preferred embodiments, at least one non-light sensitive hydrophilic layer is included with the one or more silver halide emulsion layers on each side of the film support. This layer may be called an interlayer or overcoat, or both.

The silver halide emulsion layers comprise one or more types of silver halide grains responsive to X-radiation. Silver halide grain compositions particularly contemplated include those having at least 80 mol % bromide (preferably at least 98 mol % bromide) based on total silver in a given emulsion layer. Such emulsions include silver halide grains composed of, for example, silver bromide, silver iodobromide, silver chlorobromide, silver iodochlorobromide, and silver chloroiodobromide. Iodide is generally limited to no more than 3 mol % (based on total silver in the emulsion layer) to facilitate more rapid processing. Preferably iodide is limited to no more than 2 mol % (based on total silver in the emulsion layer) or eliminated entirely from the grains. The silver halide grains in each silver halide emulsion unit (or silver halide emulsion layers) can be the same or different, or mixtures of different types of grains.

The silver halide grains useful in this invention can have any desirable morphology including, but not limited to, cubic, octahedral, tetradecahedral, rounded, spherical or other non-tabular morphologies, or be comprised of a mixture of two or more of such morphologies. Preferably, the grains are tabular grains and the emulsions are tabular grain emulsions in each silver halide emulsion layer.

In addition, different silver halide emulsion layers can have silver halide grains of the same or different morphologies as long as at least 50% of the grains are tabular grains. For cubic grains, the grains generally have an ECD of at least 0.8 μm and less than 3 μm (preferably from about 0.9 to about 1.4 μm). The useful ECD values for other non-tabular morphologies would be readily apparent to a skilled artisan in view of the useful ECD values provided for cubic and tabular grains.

Generally, the average ECD of tabular grains used in the films is from about 0.9 μm to about 4 μm. Most preferred ECD values are from about 1.6 to about 2.8 μm. The average thickness of the tabular grains is generally from about 0.09 to about 0.11 μm and preferably from about 0.095 to about 0.105 μm.

It may also be desirable to employ silver halide grains that exhibit a coefficient of variation (COV) of grain ECD of less than 20% and, preferably, less than 10%. In some embodiments, it may be desirable to employ a grain population that is as highly monodisperse as can be conveniently realized.

Generally, at least 50% (and preferably at least 80%) of the silver halide grain projected area in each silver halide emulsion layer is provided by tabular grains having an average aspect ratio greater than 5, and more preferably greater than 10. The remainder of the silver halide projected area is provided by silver halide grains having one or more non-tabular morphologies.

Tabular grain emulsions that have the desired composition and sizes are described in greater detail in the following patents, the disclosures of which are incorporated herein by reference:

U.S. Pat. No. 4,414,310 (Dickerson), U.S. Pat. No. 4,425,425 (Abbott et al), U.S. Pat. No. 4,425,426 (Abbott et al), U.S. Pat. No. 4,439,520 (Kofron et al), U.S. Pat. No. 4,434,226 (Wilgus et al), U.S. Pat. No. 4,435,501 (Maskasky), U.S. Pat. No. 4,713,320 (Maskasky), U.S. Pat. No. 4,803,150 (Dickerson et al), U.S. Pat. No. 4,900,355 (Dickerson et al), U.S. Pat. No. 4,994,355 (Dickerson et al), U.S. Pat. No. 4,997,750 (Dickerson et al), U.S. Pat. No. 5,021,327 (Bunch et al), U.S. Pat. No. 5,147,771 (Tsaur et al), U.S. Pat. No. 5,147,772 (Tsaur et al), U.S. Pat. No. 5,147,773 (Tsaur et al), U.S. Pat. No. 5,171,659 (Tsaur et al), U.S. Pat. No. 5,252,442 (Dickerson et al), U.S. Pat. No. 5,370,977 (Zietlow), U.S. Pat. No. 5,391,469 (Dickerson), U.S. Pat. No. 5,399,470 (Dickerson et al), U.S. Pat. No. 5,411,853 (Maskasky), U.S. Pat. No. 5,418,125 (Maskasky), U.S. Pat. No. 5,494,789 (Daubendiek et al), U.S. Pat. No. 5,503,970 (Olm et al), U.S. Pat. No. 5,536,632 (Wen et al), U.S. Pat. No. 5,518,872 (King et al), U.S. Pat. No. 5,567,580 (Fenton et al), U.S. Pat. No. 5,573,902 (Daubendiek et al), U.S. Pat. No. 5,576,156 (Dickerson), U.S. Pat. No. 5,576,168 (Daubendiek et al), U.S. Pat. No. 5,576,171 (Olm et al), and U.S. Pat. No. 5,582,965 (Deaton et al). The patents to Abbott et al, Fenton et al, Dickerson and Dickerson et al are also cited and incorporated herein to show conventional radiographic film features in addition to gelatino-vehicle, high bromide (≧80 mol % bromide based on total silver) tabular grain emulsions and other features useful in the present invention.

A variety of silver halide dopants can be used, individually and in combination, to improve contrast as well as other common properties, such as speed and reciprocity characteristics. A summary of conventional dopants to improve speed, reciprocity and other imaging characteristics is provided by *Research Disclosure*, Item 38957, cited above, Section I. Emulsion grains and their preparation, sub-section D. Grain modifying conditions and adjustments, paragraphs (3), (4) and (5).

It is essential however that one silver halide emulsion layer on each side of the support contain one or more rhodium dopants for the tabular silver halide grains. These dopants must be present independently in each layer, in an amount of from about $1\times10^{-5}$ to about $5\times10^{-5}$ mole per mole of silver in each emulsion layer, and preferably at from about $2\times10^{-5}$ to about $4\times10^{-5}$ mol/mol Ag in each emulsion layer. The amount of rhodium dopant can be the same or different in these layers.

Preferably, the amount of rhodium dopant is the same in each of the silver halide emulsion layers.

Useful rhodium dopants are well known in the art and are described for example in U.S. Pat. No. 3,737,313 (Rosecrants et al), U.S. Pat. No. 4,681,836 (Inoue et al) and U.S. Pat. No. 2,448,060 (Smith et al). representative rhodium dopants include, but are not limited to, rhodium halides (such as rhodium monochloride, rhodium trichloride, diammonium aquapentachlororhodate, and rhodium ammonium chloride), rhodium cyanates {such as salts of $[Rh(CN)_6]^{-3}$, $[RhF(CN)_5]^{-3}$, $[RhI_2(CN)_4]^{-3}$ and $[Rh(CN)_5(SeCN)]^{-3}$}, rhodium thiocyanates, rhodium selenocyanates, rhodium tellurocyanates, rhodium azides, and others known in the art, for example as described in *Research Disclosure*, Item 437013, page 1526, September 2000 and publications listed therein, all incorporated herein by reference. The preferred rhodium dopant is diammonium aquapentachlororhodate. Mixtures of dopants can be used also.

A general summary of silver halide emulsions and their preparation is provided by *Research Disclosure*, Item 38957, cited above, Section I. Emulsion grains and their preparation. After precipitation and before chemical sensitization the emulsions can be washed by any convenient conventional technique using techniques disclosed by *Research Disclosure*, Item 38957, cited above, Section III. Emulsion washing.

The emulsions can be chemically sensitized by any convenient conventional technique as illustrated by *Research Disclosure*, Item 38957, Section IV. Chemical Sensitization: Sulfur, selenium or gold sensitization (or any combination thereof) are specifically contemplated. Sulfur sensitization is preferred, and can be carried out using for example, thiosulfates, thiosulfonates, thiocyanates, isothiocyanates, thioethers, thioureas, cysteine or rhodanine. A combination of gold and sulfur sensitization is most preferred.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 38957, Section VII. Antifoggants and stabilizers, and Item 18431, Section II: Emulsion Stabilizers, Antifoggants and Antikinking Agents.

It may also be desirable that one or more silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or ═S moiety. Such compounds include, but are not limited to, 5-mercapotetrazoles, dithioxotriazoles, mercapto-substituted tetraazaindenes, and others described in U.S. Pat. No. 5,800,976 (Dickerson et al) that is incorporated herein by reference for the teaching of the sulfur-containing covering power enhancing compounds. Such compounds are generally present at concentrations of at least 20 mg/silver mole, and preferably of at least 30 mg/silver mole. The concentration can generally be as much as 2000 mg/silver mole and preferably as much as 700 mg/silver mole.

It may again be desirable that one or more silver halide emulsion layers on each side of the film support include dextran or polyacrylamide as water-soluble polymers that can also enhance covering power. These polymers are generally present in an amount of at least 0.1:1 weight ratio to the gelatino-vehicle (described below), and preferably in an amount of from about 0.3:1 to about 0.5:1 weight ratio to the gelatino-vehicle.

The silver halide emulsion layers and other hydrophilic layers on both sides of the support of the radiographic film generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure*, Item 38957, Section II. Vehicles, vehicle extenders, vehicle-like addenda and vehicle related addenda. The emulsions themselves can contain peptizers of the type set out in Section II, paragraph A. Gelatin and hydrophilic colloid peptizers. The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes and polyacrylamides (including polymethacrylamides). Dextrans can also be used. Examples of such materials are described for example in U.S. Pat. No. 5,876,913 (Dickerson et al), incorporated herein by reference.

The silver halide emulsion layers (and other hydrophilic layers) in the radiographic films of this invention are generally fully hardened using one or more conventional hardeners.

Conventional hardeners can be used for this purpose, including but not limited to formaldehyde and free dialdehydes such as succinaldehyde and glutaraldehyde, blocked dialdehydes, (α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydihydroquinoline, N-carbamoyl pyridinium salts, carbamoyl oxypyridinium salts, bis(amidino) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (e.g., mucochloric and mucobromic acids), onium-substituted acroleins, vinyl sulfones containing other hardening functional groups, polymeric hardeners such as dialdehyde starches, and copoly(acrolein-methacrylic acid).

In each silver halide emulsion layer in the radiographic film, the level of silver is generally at least 14 and no more than 16 mg/dm$^2$, and preferably at least 14.5 and no more than 15.5 mg/dm$^2$. In addition, the total coverage of polymer vehicle in each silver halide emulsion layer is generally at least 30 and no more than 34 mg/dm$^2$, and preferably at least 31 and no more than 3 mg/dm$^2$. The amounts of silver and polymer vehicle on the two sides of the support can be the same or different. These amounts refer to dry weights.

The radiographic films generally include a surface protective overcoat on each side of the support that is typically provided for physical protection of the emulsion layers. Each protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are illustrated by *Research Disclosure*, Item 38957, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of protective overcoat addenda, such as anti-matte particles, in the interlayers. The overcoat on at least one side of the support can also include a blue toning dye or a tetraazaindene (such as 4-hydroxy-6-methyl-1,3,3a,7-tetraazaindene) if desired.

The protective overcoat is generally comprised of a hydrophilic colloid vehicle, chosen from among the same types disclosed above in connection with the emulsion layers. In conventional radiographic films protective overcoats are provided to perform two basic functions. They provide a layer between the emulsion layers and the surface of the element for physical protection of the emulsion layer during handling and processing. Secondly, they provide a convenient location for the placement of addenda, particularly those that are intended to modify the physical properties of the radiographic film. The protective overcoats of the films of this invention can perform both these basic functions.

The various coated layers of radiographic films of this invention can also contain tinting dyes to modify the image tone to transmitted or reflected light. These dyes are not decolorized during processing and may be homogeneously or heterogeneously dispersed in the various layers. Preferably, such non-bleachable tinting dyes are in a silver halide emulsion layer.

The radiographic imaging assemblies of the present invention are composed of a radiographic film as described herein and intensifying screens adjacent the front and back of the radiographic film. The screens are typically designed to absorb X-rays and to emit electromagnetic radiation having a wavelength greater than 300 nm. These screens can take any convenient form providing they meet all of the usual requirements for use in radiographic imaging, as described for example in U.S. Pat. No. 5,021,327 (noted above), incorporated herein by reference. A variety of such screens are commercially available from several sources including by not limited to, LANEX™, X-SIGHT™ and InSight™ Skeletal screens available from Eastman Kodak Company. The front and back screens can be appropriately chosen depending upon the type of emissions desired, the photicity desired, whether the films are symmetrical or asymmetrical, film emulsion speeds, and % crossover.

Exposure and processing of the radiographic films of this invention can be undertaken in any convenient conventional manner. The exposure and processing techniques of U.S. Pat. No. 5,021,327 and 5,576,156 (both noted above), are typical for processing radiographic films. Other processing compositions (both developing and fixing compositions) are described in U.S. Pat. No. 5,738,979 (Fitterman et al), U.S. Pat. No. 5,866,309 (Fitterman et al), U.S. Pat. No. 5,871,890 (Fitterman et al), U.S. Pat. No. 5,935,770 (Fitterman et al), U.S. Pat. No. 5,942,378 (Fitterman et al), all incorporated herein by reference. The processing compositions can be supplied as single- or multi-part formulations, and in concentrated form or as more diluted working strength solutions.

It is particularly desirable that the films of this invention be processed ("dry to dry") within 90 seconds, and preferably within 45 seconds and at least 20 seconds, including developing, fixing, any washing (or rinsing), and drying. Such processing can be carried out in any suitable processing equipment including but not limited to, a Kodak X-OMAT™ RA 480 processor that can utilize Kodak Rapid Access processing chemistry. Other "rapid access processors" are described for example in U.S. Pat. No. 3,545,971 (Barnes et al) and EP-A-0 248,390 (Akio et al). Preferably, the black-and-white developing compositions used during processing are free of any gelatin hardeners, such as glutaraldehyde.

Since rapid access processors employed in the industry vary in their specific processing cycles and selections of processing compositions, the preferred radiographic films satisfying the requirements of the present invention are specifically identified as those that are capable of dry-to-dye processing according to the following reference conditions:

| | |
|---|---|
| Development | 11.1 seconds at 35° C., |
| Fixing | 9.4 seconds at 35° C., |
| Washing | 7.6 seconds at 35° C., |
| Drying | 12.2 seconds at 55–65° C. |

Any additional time is taken up in transport between processing steps. Typical black-and-white developing and fixing compositions are described in the Example below.

Radiographic kits of the present invention can include one or more samples of radiographic film of this invention, one or more intensifying screens used in the radiographic imaging assemblies, and/or one or more suitable processing compositions (for example black-and-white developing and fixing compositions). Preferably, the kit includes all of these components. Alternatively, the radiographic kit can include a radiographic imaging assembly as described herein and one or more of the noted processing compositions.

The following example is provided for illustrative purposes, and is not meant to be limiting in any way.

EXAMPLE

Radiographic Film A (Control)

Radiographic Film A was a dual coated having silver halide emulsions on both sides of a blue-tinted 178 μm transparent poly(ethylene terephthalate) film support. The emulsions were chemically sensitized with sodium thiosulfate, potassium tetrachloroaurate, sodium thiocyanate and potassium selenocyanate, and spectrally sensitized with 680 mg/Ag mole of anhydro-5,5-dichloro-9-ethyl-3,3'-bis (3-sulfopropyl)oxacarbocyanine hydroxide, followed by 300 mg/Ag mole of potassium iodide. The silver halide grains in Film A had average dimensions of 2.9 μm diameter and 0.08 μm in thickness.

Radiographic Film A had the following layer arrangement on each side of the film support:

Overcoat
Interlayer
Emulsion Layer

The noted layers were prepared from the following formulations.

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Whale oil lubricant | 0.15 |
| Interlayer Formulation | |
| Gelatin vehicle | 3.4 |
| AgI Lippmann emulsion (0.08 μm) | 0.11 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |
| Emulsion Layer Formulation | |
| T-grain emulsion (AgBr 2.9 × 0.08 μm) | 19.4 |
| Gelatin vehicle | 26.3 |
| 4-hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.44 |

Radiographic Film B (Control)

Radiographic Film B had the same layer arrangement and formulations as Film A except that the T-grain emulsion was coated at 17.2 mg/dm$^2$.

Radiographic Film C (Control)

Radiographic Film C had the same layer arrangement and formulations as Film A except that the T-grain emulsion was coated at 15.1 mg/dm$^2$.

Radiographic Film D (Control)

Radiographic Film D had the same layer arrangement and formulations as Film A except that the T-grain emulsion contained AgBr grains having dimensions of 2.4 μm average diameter and 0.105 μm thickness.

Radiographic Film E (Control)

Radiographic Film E had the same layer arrangement and formulations as Film D except that the T-grain emulsion was coated at 17.2 mg/dm$^2$.

Radiographic Film F (Control)

Radiographic Film F had the same layer arrangement and formulations as Film D except that the T-grain emulsion was coated at 15.1 mg/dm$^2$.

Radiographic Film J (Invention)

Radiographic Film J is an embodiment of this invention and was like Radiographic Film A except that the silver bromide grains had an average diameter of 2.5 μm and a 0.10 μm thickness, and were doped with diammonium aquapentachlororhodate dopant at $3.89\times10^{-5}$ mole/mole of silver.

Radiographic Film K (Invention)

Radiographic Film K was another embodiment of this invention and was like Radiographic Film J except that the silver halide emulsion was coated at 17.2 mg/dm$^2$.

Radiographic Film L (Invention)

Radiographic Film L was still another embodiment of this invention and was like Radiographic Film J except that the silver halide emulsion was coated at 15.1 mg/dm$^2$.

Samples of each radiographic films identified above were exposed through a graduated density step tablet using a MacBeth sensitometer for 1/50 second and a 500 watt General Electric DMX projector lamp calibrated to 2650° K filtered with a Coming C4010 filter to simulate a green-light emitting X-radiation intensifying screen exposure.

Processing of the exposed film samples for sensitometric evaluation was carried out using a processor commercially available under the trademark KODAK RP X-OMAT film Processor M6A-N. Development was carried out using the following black-and-white developing composition:

| | |
|---|---|
| Hydroquinone | 30 g |
| Phenidone | 1.5 g |
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH 10 | |

The film samples were in contact with the developer in each instance for less than 90 seconds. Fixing was carried out using KODAK RP X-OMAT LO Fixer and Replenisher fixing composition (Eastman Kodak Company).

The results of the sensitometric evaluations of the film samples are presented in TABLE I below.

Optical densities were expressed in terms of diffuse density as measured by a commercially available X-rite Model 310 M densitometer that was calibrated to ANSI standard PH 2.19 and was traceable to a National Bureau of Standards calibration step tablet. The characteristic curve (density vs. logE) was plotted for each radiographic film. Speed was measured at a density of $1.0+D_{min}$. Midscale contrast was measured as the slope of the curve between a density of $D_{min}+0.25$ to a density of $D_{min}+2.0$. Lower scale contrast was measured as the slope between a density of 0.85 to the density achieved shifting −0.3 logE. Upper scale contrast was measured as the slope of the line measured between a density of $1.5+D_{min}$ to $2.85+D_{min}$.

Image tone is a measure of the color of the developed silver as viewed transmission. The values are determined by CIELAB standards for spectra recorded from 400 to 700 nm using D5500 as the standard illuminant. Image tone is the b* value from the CIELAB measurement and is the measure of the yellow-blue color balance. The more negative the number the bluer the developed silver image appears. Warm (more positive b* values) is considered by many radiologists to be undesirable. A difference of 0.7b* units is considered a just noticeable difference for a typical observer.

As can be seen from these data, Films A–C provided excellent photographic speed and contrast, and provided the potential for significant silver reductions that allow for lower manufacturing costs as well as less processing demands. However, Films A–C exhibited undesirably warm image tones (relatively positive b* values).

Films D and E that have higher coverage T-grain silver halide emulsions, provided improved image tone but had undesirably lower contrast. Thus, useful silver reduction is not possible with those films.

Films J, K and L provided excellent image tone, high speed and high contrast even with significantly reduced silver coverage. This was achieved by using a rhodium dopant in the silver halide T-grain emulsion. This result was surprising since the use of the rhodium doped silver halide emulsions had an average grain size similar to those in the emulsions lacking the dopant (Controls).

TABLE I

| Film | Silver Halide Coverage (mg/dm$^2$) | Average Silver Halide Grain Sizes ($\mu$m × $\mu$m) | Speed | Contrast | Image Tone |
|---|---|---|---|---|---|
| Control A | 19.4 | 2.9 × 0.085 | 461 | 3.2 | −5.5 |
| Control B | 17.2 | 2.9 × 0.085 | 459 | 3.1 | −5.4 |
| Control C | 15.1 | 2.9 × 0.085 | 455 | 2.9 | −5.5 |
| Control D | 19.4 | 2.4 × 0.105 | 450 | 2.7 | −6.3 |
| Control E | 17.2 | 2.4 × 0.105 | 446 | 2.5 | −6.5 |
| Control F | 15.1 | 2.4 × 0.105 | 443 | 2.3 | −6.4 |
| Invention J | 19.4 | 2.5 × 0.10 | 453 | 3.5 | −6.4 |
| Invention K | 17.2 | 2.5 × 0.10 | 451 | 3.4 | −6.4 |
| Invention L | 15.1 | 2.5 × 0.10 | 450 | 3.3 | −6.5 |

The invention has been described in detail with particular reference to preferred embodiments thereof, but it will be understood that variations and modifications can be effected within the spirit and scope of the invention.

We claim:

1. A high speed radiographic silver halide film comprising a support having first and second major surfaces and that is capable of transmitting X-radiation, said film having disposed on said first major support surface, one or more hydrophilic colloid layers including a silver halide emulsion layer, and on said second major support surface, one or more hydrophilic colloid layers including a silver halide emulsion layer, each of said silver halide emulsion layers comprising silver halide tabular grains that (a) have the same or different composition in each silver halide emulsion layer, (b) account for at least 50% of the total grain projected area within each silver halide emulsion layer, (c) have an average thickness of from about 0.09 to about 0.11 $\mu$m, and (d) have an average aspect ratio of greater than 5, all hydrophilic layers of the film being fully forehardened and wet processing solution permeable for image formation within 45 seconds, one or more of said silver halide emulsion layers also comprising a rhodium dopant for said tabular silver halide grains, said rhodium dopant being present independently in each silver halide emulsion layer in an amount of from about $1\times10^{-5}$ to about $5\times10^{-5}$ mole per mole of silver in each emulsion layer.

2. The film of claim 1 wherein said tabular silver halide grains of each silver halide emulsion is composed of at least 80% bromide based on total silver in that emulsion.

3. The film of claim 2 wherein tabular silver halide grains of each silver halide emulsion is composed of at least 98% bromide based on total silver in that emulsion.

4. The film of claim 1 wherein said tabular silver halide grains have an ECD of from about 1.6 to about 2.8 $\mu$m, and an average thickness of from about 0.095 to about 0.105 $\mu$m.

5. The film of claim 1 wherein at least 90% of the silver halide grain projected area in each silver halide emulsion layer is provided by tabular silver halide grains having an aspect ratio greater than 10.

6. The film of claim 1 further comprising an overcoat over said silver halide emulsions on each side of said film support.

7. The film of claim 1 wherein said rhodium dopant is present in at least one silver halide emulsion layer in an amount of from about $2\times10^{-5}$ to about $4\times10^{-5}$ mol/mol Ag in each emulsion layer.

8. The film of claim 7 wherein each silver halide emulsion layer comprises said rhodium dopant.

9. The film of claim 8 wherein said rhodium dopant is present in the same amount in each silver halide emulsion layer.

10. The film of claim 1 wherein said rhodium dopant is a rhodium halide, rhodium cyanate, rhodium thiocyanate, rhodium selenocyanate, rhodium tellurocyanate, rhodium azide, or a mixture of any two or more of these.

11. The film of claim 10 wherein said rhodium dopant is diammonium aquapentachlororhodate.

12. A radiographic imaging assembly comprising the radiographic film of claim 1 provided in combination with an intensifying screen on either side of the film.

13. A method comprising contacting the radiographic film of claim 1, sequentially, with a black-and-white developing composition and a fixing composition, said method being carried out within 90 seconds to provide a black-and-white image.

14. The method of claim 13 wherein said black-and-white developing composition is free of any photographic film hardeners.

15. The method of claim 12 being carried out for 45 seconds or less.

16. The method of claim 13 being carried out for from about 20 to about 90 seconds.

17. A radiographic kit comprising the radiographic film of claim 1 and one or more of the following:

a) an intensifying screen, b) a black-and-white developing composition, and c) a fixing composition.

18. A radiographic kit comprising the radiographic imaging assembly of claim 12 and one or more of the following:

a) a black-and-white developing composition, and b) a fixing composition.

19. The film of claim 1 wherein each silver halide emulsion layer comprises silver at a coverage of from about 14 to about 16 mg/dm$^2$.

* * * * *